US012098852B2

(12) United States Patent
Hedenblad et al.

(10) Patent No.: US 12,098,852 B2
(45) Date of Patent: Sep. 24, 2024

(54) USER INTERFACE FOR A HOB

(71) Applicant: ELECTROLUX APPLIANCES AKTIEBOLAG, Stockholm (SE)

(72) Inventors: Ebba Hedenblad, Stockholm (SE); Sudarat Persson, Stockholm (SE); Sara Bryde, Stockholm (SE); Rudy Bortolini, Stockholm (SE)

(73) Assignee: Electrolux Appliances Aktiebolag, Stockholm (SE)

( * ) Notice: Subject to any disclaimer, the term of this patent is extended or adjusted under 35 U.S.C. 154(b) by 1258 days.

(21) Appl. No.: 16/616,658

(22) PCT Filed: May 15, 2018

(86) PCT No.: PCT/EP2018/062634
§ 371 (c)(1),
(2) Date: Nov. 25, 2019

(87) PCT Pub. No.: WO2018/219641
PCT Pub. Date: Dec. 6, 2018

(65) Prior Publication Data

US 2021/0164662 A1 Jun. 3, 2021

(30) Foreign Application Priority Data

Jun. 2, 2017 (EP) ..... 17174185

(51) Int. Cl.
*F24C 7/08* (2006.01)

(52) U.S. Cl.
CPC ..... *F24C 7/086* (2013.01); *F24C 7/083* (2013.01)

(58) Field of Classification Search
CPC ..... F24C 7/083; F24C 7/086
(Continued)

(56) References Cited

U.S. PATENT DOCUMENTS 3,974,472 A * 8/1976 Gould, Jr. ..... G05B 19/104 345/173
4,169,222 A * 9/1979 Tucker ..... H05B 6/062 327/518

(Continued)

FOREIGN PATENT DOCUMENTS

CN 102054115 5/2011
CN 105051460 11/2015

(Continued)

OTHER PUBLICATIONS

Translation of Brazilian Office action for counterpart BR application BR 112019025067-0 dated Apr. 27, 2022, 4 pages.

(Continued)

*Primary Examiner* — Jimmy Chou
(74) *Attorney, Agent, or Firm* — Pearne & Gordon LLP

(57) ABSTRACT

A user interface for a hob that comprises at least two cooking zones is disclosed. The user interface comprises a touch-screen interface (18) for presenting operating parameters and input elements (20, 22, 24, 26, 28, 30, 32, 36, 38, 40, 42, 44, 46, 48) for adjusting such operating parameters. The touchscreen interface (18) is configured to display for each of the cooking zones an input element (20, 22, 24, 26) for selection of the respective cooking zone. In a first interface mode the input elements (20, 22, 24, 26) for selection of the cooking zones are represented in a normal display mode that is simultaneously applied to the input elements for all cooking zones, and in a second interface mode the input element (24) for a selected cooking zone is represented in a highlighted display mode different from the display mode applied to the input elements (20, 22, 26) for the remaining cooking zones.

18 Claims, 2 Drawing Sheets

(58) Field of Classification Search
USPC ..... 219/447.1, 448.12; 345/173
See application file for complete search history.

(56) References Cited

U.S. PATENT DOCUMENTS 4,282,422 A * 8/1981 Payne ..... G05F 1/452 219/486
5,572,205 A * 11/1996 Caldwell ..... H03K 17/9622 341/26
6,198,080 B1 * 3/2001 Rice ..... F24C 7/082 219/486
6,255,630 B1 * 7/2001 Barnes ..... F24C 7/082 219/486
6,924,465 B2 * 8/2005 Schilling ..... G09F 9/33 219/448.11
6,930,287 B2 * 8/2005 Gerola ..... H05B 3/746 219/448.11
6,933,477 B2 * 8/2005 Becker ..... F24C 7/082 219/720
7,126,088 B2 * 10/2006 Horton ..... F24C 7/082 99/332
7,370,649 B2 * 5/2008 Gama ..... F24C 3/126 219/448.11
8,053,708 B2 * 11/2011 Fisher ..... F24C 7/082 219/448.12
8,281,244 B2 * 10/2012 Neuman ..... G06F 3/0486 715/810
8,674,270 B2 * 3/2014 Anderson ..... F24C 7/082 219/448.12
8,736,561 B2 * 5/2014 Anzures ..... G06F 3/0485 345/173
9,532,407 B2 * 12/2016 Viroli ..... H05B 6/065
11,064,574 B2 * 7/2021 Christiansen ..... H05B 6/1245
11,520,445 B1 * 12/2022 White ..... F24C 7/083
2004/0200824 A1 * 10/2004 Boyer ..... H05B 6/6482 219/400
2005/0029245 A1 * 2/2005 Gerola ..... H05B 3/746 219/447.1
2006/0167573 A1 * 7/2006 Yamada ..... G03G 15/502 700/83
2007/0158335 A1 * 7/2007 Mansbery ..... H05B 6/6435 219/505
2012/0103966 A1 * 5/2012 Gladhill ..... F24C 7/085 219/391
2013/0092033 A1 * 4/2013 Murphy ..... A47J 36/321 99/342
2013/0092145 A1 * 4/2013 Murphy ..... H05B 6/6473 126/21 R
2013/0145316 A1 * 6/2013 Heo ..... G06F 3/04817 715/810
2013/0179815 A1 * 7/2013 Choi ..... G06F 3/04886 715/810
2013/0236613 A1 * 9/2013 Phillips ..... A23L 5/10 426/231
2013/0254714 A1 * 9/2013 Shin ..... G06F 3/0482 715/810
2013/0284722 A1 * 10/2013 Viroli ..... H05B 6/065 219/622
2014/0201688 A1 * 7/2014 Guilleminot ..... G06F 3/04883 715/863
2015/0042453 A1 2/2015 Beifuss
2015/0156824 A1 * 6/2015 Viroli ..... H05B 6/1209 219/621
2015/0176846 A1 * 6/2015 Wiedemann ..... G09G 5/377 345/636
2015/0245417 A1 * 8/2015 Fattorini ..... H05B 6/065 219/662
2015/0308694 A1 * 10/2015 Christiansen ..... H05B 6/1218 219/626
2016/0018941 A1 * 1/2016 Kim ..... G06F 9/451 345/173
2016/0034132 A1 * 2/2016 Huang ..... G06F 3/0416 345/173
2016/0037584 A1 * 2/2016 Viroli ..... G01V 3/104 324/207.17
2016/0139731 A1 * 5/2016 Kim ..... G06F 3/04883 345/173
2016/0170635 A1 * 6/2016 Iwaizumi ..... G06F 3/04883 345/173
2016/0253080 A1 * 9/2016 Ban ..... G06F 3/04883 715/771
2016/0253088 A1 * 9/2016 Isozaki ..... G06F 3/04166 345/173
2016/0299595 A1 * 10/2016 Bach ..... F24C 7/086
2016/0320068 A1 * 11/2016 Koehler ..... F24C 7/086
2017/0023256 A1 * 1/2017 Bach ..... G05B 15/02
2017/0150359 A1 * 5/2017 Adderly ..... G06F 21/36
2017/0199658 A1 * 7/2017 Stoufer ..... G06F 3/04842
2017/0238749 A1 * 8/2017 Vengroff ..... A47J 36/321
2017/0292712 A1 * 10/2017 Alexander ..... H03K 17/962
2017/0299195 A1 * 10/2017 Bach ..... H05B 1/0202
2019/0204995 A1 * 7/2019 Spahlholz ..... F24C 7/086
2019/0354195 A1 * 11/2019 Beliveau ..... F24C 7/083
2020/0011534 A1 * 1/2020 Park ..... G05B 19/0428
2020/0326812 A1 * 10/2020 Choo ..... G06F 3/03547
2022/0201810 A1 * 6/2022 Han ..... G06F 1/3206
2022/0210874 A1 * 6/2022 Kikuchi ..... H05B 6/062
2023/0012630 A1 * 1/2023 Son ..... H05B 6/065
2023/0027830 A1 * 1/2023 Corwin ..... G06F 3/147

FOREIGN PATENT DOCUMENTS

CN 106664752 5/2017
DE 19918290 C1 1/2001
DE 102010001002 8/2010
DE 102015120397 1/2017
DE 102015120397 A1 * 1/2017
DE 102015120409 1/2017
EP 2066148 6/2009
EP 2258987 12/2010
EP 2506662 10/2012
EP 2551600 1/2013
EP 2573470 3/2013
EP 2709424 3/2014
EP 2983150 2/2016
EP 3171667 5/2017
EP 3171667 A1 * 5/2017 ..... H05B 6/062
EP 3410016 A1 * 12/2018 ..... F24C 7/083
WO 2009050117 4/2009

OTHER PUBLICATIONS

International Search Report and Written Opinion in PCT/EP2018/062634 dated Jul. 18, 2018, 10 pages.
EP Office action for counterpart EP application 18722642.8 dated Oct. 19, 2021, 10 pages.

* cited by examiner

USER INTERFACE FOR A HOB

The present invention is directed to a user interface for a hob that comprises at least two cooking zones, as well as to a hob comprising such a user interface.

While in many conventional hobs, such as solid plate hobs, ceramic electric hobs, or induction hobs, there either is provided one control knob for each of the cooking zones, or there is provided a touch sensitive region having dedicated switching zones for each of the cooking zones, there is room for improvement of the controllability and user-friendliness of the control elements that are employed for the input, and similarly for the display elements provided for the output, of the operating parameters involved.

In view of the above, it is an object of the present invention to provide for a user interface for a hob, particularly an induction hob, that comprises at least two cooking zones, wherein the user interface provides for more user-friendliness than conventional devices and thus facilitates operation of the hob.

In accordance with the present invention this object is solved by a user interface for a hob that comprises at least two cooking zones, the user interface comprising a touch-screen interface for presenting operating parameters and input elements for adjusting such operating parameters, wherein the touchscreen interface is configured to display for each of the cooking zones an input element for selection of the respective cooking zone, wherein in a first interface mode the input elements for selection of the cooking zones are represented in a normal display mode that is simultaneously applied to the input elements for all cooking zones, and wherein in a second interface mode the input element for a selected cooking zone is represented in a highlighted display mode different from the display mode applied to the input elements for the remaining cooking zones.

Preferably the hob of the present invention comprises at least two cooking zones, however, more preferably the hob comprises at least three cooking zones, further preferably at least four cooking zones and most preferably more than four cooking zones. When such user interface is operated in a first interface mode, such as upon switching on the hob, the input elements for selection of the cooking zones are displayed all in a similar manner, such as by symbols of similar size and color, which may be displayed at a location of the touch-screen interface that corresponds to the physical orientation of the respective cooking zone. When upon selection of a cooking zone which shall be used for a cooking process, the user interface is operated in a second interface mode, the selected cooking zone is represented in a highlighted display mode so as to provide for a clear and well visible differentiation from the input elements for the other cooking zones. Such a highlighted display mode can be provided by displaying the respective input element, and possibly any further input element for adjusting an operating parameter of the selected cooking zone, in an enlarged size, in bold characters, in a different color, and/or at a prominent location, such as centered in the middle of the touchscreen interface, whereas the input elements for the remaining cooking zones are shifted to a peripheral region of the touchscreen interface.

In this manner not only the process of operating the respective cooking zone is facilitated, but also the risk of inadvertently activating another cooking zone, different from the one to be selected, is reduced.

Preferably, in the second interface mode the input element for the selected cooking zone is represented together with at least one further input element for adjusting an operating parameter of the selected cooking zone, such as a power level for setting the temperature of the selected cooking zone, or a temperature progress for conducting a preset cooking program in which different temperatures are employed over time. Thus, for example, there can be provided for a cooking program in which in an initial boiling phase the cooking zone is heated to a higher level so as to provide for a boiling operation, which is followed by a subsequent heating phase in which the cooking zone is heated to a lower level so as to provide for a simmering operation.

The input element for the selected cooking zone further can be represented together with an input element for selecting various timer functions, such as auto-on or auto-off for switching on or off the heating elements at a selected time or after a selected duration. Thus, the input element can be configured for the input and display of time values, such as a delay, a selected finishing time, a duration and the like which may be displayed during the cooking operation as a stop watch or count-down.

The input element for the selected cooking zone also can be represented together with one or more input elements for adjusting the size and shape of the area to be heated within the respective cooking zone, such as by activating or deactivating individual heating elements that are provided within the cooking zone.

The user interface further can be configured to provide for an indication when any of the cooking zones has been heated and thus still is hot or warm, which indication can be represented in a highlighted display when the user interface is in the second interface mode.

As mentioned above, in order to provide in the second interface mode for a highlighted display of the input elements for the selected cooking zone, the input elements for the selected cooking zone can be displayed in a central region of the touchscreen interface, whereas the input elements for the remaining cooking zones are displayed in a peripheral region of the touchscreen interface. Thus, for example in a hob of rectangular layout having four cooking zones that are located in four quarters of the hob area, wherein in the first interface mode the input elements for selection of the cooking zones are displayed at a location of the touchscreen interface that corresponds to the physical location of the respective cooking zone, when selecting one of the cooking zones and thus operating the touchscreen interface in a second interface mode, the input elements of the selected cooking zone can be displayed in the central area of the touchscreen interface, whereas those for selecting any of the other three cooking zones are shifted towards a peripheral region of the touchscreen interface.

The input element for adjusting operating parameters of the selected cooking zone can be formed by displaying a representation of possible values for the operating parameter, such as a selection of possible values for the parameter which for the power level can be a series of numerical values from which the user can select, or a graphical representation of the possible range, which can be displayed for example as a bar of constant or increasing height. Particularly when more complex input choices are to be offered, such as different cooking programs, the input element for adjusting operating parameters of the selected cooking zone also can be configured to be displayed as a scroll-down menu which indicates the available options in text form.

In the alternative, rather than displaying a pool of possible values or a selection to choose from, the actual parameter value can be displayed together with input means, such as "+" and "−" buttons, for selectively increasing or decreasing the parameter.

In case that certain functions shall always be available, such as an on/off button for activating or deactivating the touchscreen interface, a menu button, a pause button, a lock button, or the like, there can be provided at least one touch sensitive key element next to the touchscreen interface. Thus, in order to facilitate the manufacturing of such designated single-purpose input elements, rather than providing such input elements on the touchscreen interface, there can be provided additional key elements next to the touchscreen interface which can be designed as touch sensitive elements that are located underneath a printed and backlit region of a glass element which is located adjacent or around the touchscreen interface. In this manner there can be implemented in a cost-effective manner input elements for functions which either shall be always available, such as an on/off button, or which shall remain available during operation or during a certain operation period, such as a menu button, a lock button and a pause button, which can be switched on and thus made visible on power-up of the hob, so as to remain active for the entire length of a cooking process.

In preferred embodiments the touchscreen interface comprises a polychromatic display, so as to provide for the ability to display certain elements in different colors. Thus, for example a symbol or the power level of cooking zone can be displayed in a different color, such as in red, as soon as the cooking zone is turned on, so as to provide for a warning function.

In further embodiments the touchscreen interface can be configured to display input elements and parameters that relate to temporarily disabled functions in a semitransparent or faded fashion. While thus it immediately can be made visible to a user that certain functions are presently not available or cannot be changed, such as during a state when an operation is paused or when the user interface has been set into a child-safe mode, the value of the parameter or the selected function nevertheless still is displayed.

In further preferred embodiments the touchscreen interface can be configured for operation of at least two adjacent cooking zones as a single combined cooking zone by displaying the respective input elements and parameter indications as a single element that applies to all the cooking zones which constitute the combined cooking zone. For example in a hob comprising four cooking zones, the interface can be configured such that the two cooking zones located in the left half of the hob can be combined to constitute a combined cooking zone of lengthy shape, such as for the heating of a casserole or the warming of platters, wherein any settings that are made, such as a setting of the power level, the conduction of a cooking program with varying temperatures, or timer functions, are applied simultaneously for both the cooking zones. When implementing such a combined cooking zone operation, it also can be advantageous to restrict the combined cooking operation to only individual functions, such as cooking programs and timer functions, but to nevertheless allow for an independent setting of the power levels that are applied in the individual cooking zones which in combination constitute the combined cooking zone. In this manner, certain areas of the combined cooking zone may be heated to a different temperature than other regions of the combined cooking zone, so as to provide for a temperature gradient within the combined cooking zone, for example when heating a casserole in which there is to be prepared in one region a roast and in a further region a side dish, such as vegetables.

In one particular embodiment of the present invention a cooking zone is associated with one heating zone corresponding to one heat transferring element, e.g. a radiant heating element or an induction coil, which is arranged below the cooking panel, e.g. the glass ceramic plate.

Such hob, preferably induction hob, according to the present invention preferably comprises at least one energy power unit for transferring heating power to at least one heating zone.

A cooking zone thus comprises preferably at least one heating zone, more preferably at least two, still more preferably at least three heating zones. Additionally, or alternatively, the hob may be configured such that the number of heating zones associated with one cooking zone may vary dependent on the needs of the cook and/or the size, form or kind of cookware placed on the cooking surface.

The energy power unit comprises preferably at least one generator for providing heating power to the at least one heating zone. The heating power may be provided, particularly by heat, more particularly heat radiation. Alternatively or additionally, the heating power may be provided by heat generating power, particularly a heat generating magnetic field, more particularly an induction field. Accordingly, the inventive cooking hob, preferably is an induction hob.

A heating zone preferably is associated with one heating transfer element. The heating transfer element particularly may comprise a heating coil, preferably an induction coil. Preferably, a heating zone may be associated with more than one heating transfer element. Particularly, a heating zone may be associated with 2, 3 or 4, or more than 4 heating transfer elements.

The energy power unit, and particularly the associated power circuit unit may be configured to be connected to at least one, preferably two phases of a mains supply. There by the energy power unit may particularly be provided in the form of a half-bridge configuration and/or a quasi-resonant configuration.

In order to avoid an unwanted or inappropriate operation of the hob, the touchscreen interface can be configured for operation in a child-safe mode in which all input elements are deactivated until a predetermined unlock procedure is performed. Such unlock procedure can be, for example, an input of a passkey at a single input element, such as a multi-digit number. In other embodiments the unlock procedure may consist in the activation of several input elements in a predetermined unlock sequence, wherein for example a plurality of labeled keys have to be activated in a certain order, such as keys with letters which have to be pressed in an ascending or descending order. In this manner, a potentially dangerous operation of the hob by not qualified persons, such as by an unattended child, can be avoided.

In accordance with a further aspect of the present invention, the above objects are solved by a hob which comprises a plurality of cooking zones each having at least one heating element for heating the respective cooking zone, a user interface as it has been described above, and a controller coupled to the user interface and the heating elements for controlling the heating elements based on inputs received at the user interface. Such hob can be any hob that comprises a plurality of cooking zones, irrespective of how the cooking zones are heated, and thus can be a hob having solid plates, a ceramic electric hob, an induction hob, a gas fired hob, or a combination hob in which at least one heating zone is heated in a different manner than at least one of the other heating zones.

In embodiments, the hob can detect the presence or absence of cooking ware in a cooking zone, wherein the user interface is configured to display input elements of the respective cooking zone when cooking ware is detected in such cooking zone, i.e. to automatically switch on or display the respective input elements when a user places a pot within the cooking zone, Alternatively or additionally the controller can be configured to deactivate the heating element of the respective cooking zone when an absence of cooking ware in such cooking zone is detected, such as to switch off the heating element of a cooking zone when a pot that has been heated in such zone is removed. In order to allow a user to remove the pot for a short period of time without switching off the heating element, so as to allow for example to briefly take a pot to a kitchen sink so as add or remove liquid, after which the cooking procedure shall be continued, the function of deactivating the heating element of the respective cooking zone when an absence of cooking ware in is detected, can be implemented with a predetermined or adjustable delay, wherein the operation is continued if it is detected that the cooking pot is returned to the cooking zone within the delay period.

In preferred embodiments, the hob can comprise means for detecting the temperature of a cooking zone, of cooking ware present in said cooking zone and/or of a food item being processed in said cooking zone, via direct measurement such as by means of fixedly installed temperature sensors or by mobile wireless or wire-bound probes that are to be placed in contact with the cooking ware or the food item being processed. In addition or alternatively to such direct measurement, in certain types of hobs, for example in induction hobs, it also is possible to estimate the temperature of the cooking ware or of the food item being processed by evaluation of the electric power that is supplied to the respective cooking zone. In any such embodiments, the controller further preferably is configured to adapt the operation of the heating elements based on data received from the temperature detecting means, so that the amount of power that is supplied to the respective heating zone can be effectively adapted to the temperature actually achieved.

In preferred embodiments of the hob suggested herein, the touchscreen interface is configured for input and output of timer data for at least one of the cooking zones, and the controller further is configured to adapt the operation of the heating elements based on the said timer data. Thus, for example auto-on, auto-off, and delay functions for switching on or off the heating elements at a selected time or after a selected duration can be implemented. Furthermore, the cooking zones can be operated in accordance with predetermined cooking programs in which the temperature in the cooking zone is varied over time, such as providing for a boiling period at a higher power level, followed by a simmering period that is conducted at a lower power level.

In further embodiments, the hob can generate audio signals coupled to the controller, wherein the controller further is configured to generate audio signals in dependency of sensor data, user inputs and/or a selected operation function. By providing for such audio signaling feature, various warning or information messages can be output to a user, which messages may be based, amongst others, on: generating sensor data, such as temperature data, a detection of the placement of cooking ware in, or the removal of cooking ware from, any of the cooking zones, and/or a detection of spilling, such as fluids, operation functions, such as a cooking program that reminds the user of the certain activities to be taken, such as an addition of ingredients to be added after a certain preparation time, timer data, such as the begin or end of a preset cooking period, or a selected cooking duration, a user input, so as to provide for example for a confirmation tone to indicate that an input has been received, a warning after a power outage, so as to alert the user that a cooking operation may have been interrupted or untimely terminated, and/or clock adjustments should be checked and possibly corrected, or the exceeding of a power demand, such as by simultaneously setting all cooking zones to a maximum level.

Preferred embodiments of the present invention are described below by reference to the drawings, in which FIG. 1 shows a user interface for a hob made in accordance with the present invention upon power-up of the hob, with the interface being set in a first interface mode;

In the following the present invention will be described by reference to exemplary embodiments of a user interface that are designed for an induction hob or electric glass ceramic hob having four cooking zones, wherein two of the cooking zones can be operated in a combined mode.

Figure 1:
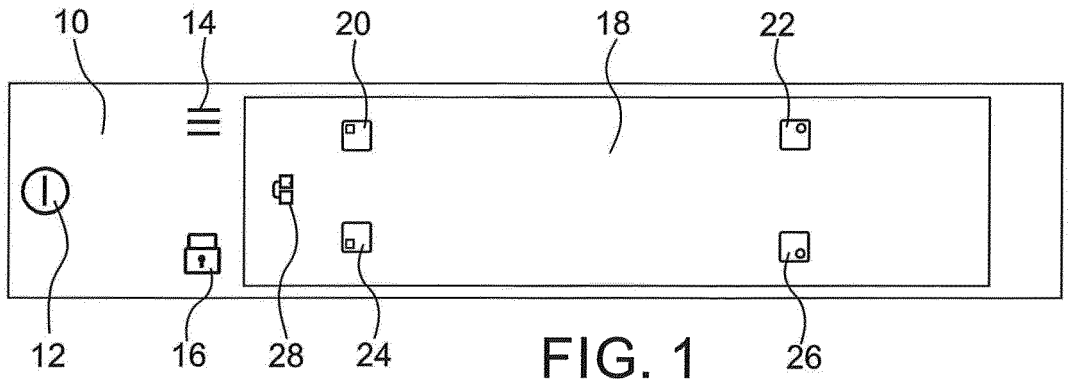

As shown in FIG. 1, the user interface comprises a panel 10 in which there are provided several switch elements 12, 14, 16 of designated function and a touchscreen interface 18. To provide for a smooth surface of uniform appearance, panel 10 is a glass panel that is designed to form an integral part of a glass ceramic plate in which there are provided the cooking zones. While the switch elements 12, 14 and 16 each comprise a touch sensitive element arranged below the glass panel, a symbol for indicating the function of the switch is formed by a printing provided at the bottom side of the glass plate, which printing is made visible by activation of a backlight that also is provided at the bottom side of the glass plate. While thus in the switched-off state of the hob, the switch elements 14 and 16 and the touchscreen interface 18 are virtually invisible and merge into the overall appearance of the glass plate, switch element 12 which constitutes the On/Off button for the hob, preferably comprises a permanently discernible marking, such as a printing that always is visible, or a haptic marking in the smooth surface of the glass plate.

Upon powering up the hob by touching switch element 12 for a predetermined minimum duration, switch element 14 which is a "Menu" button and switch element 16 which in the illustrated embodiment is a "Lock" button are backlit and thus can be activated. The same also applies to touchscreen interface 18 which upon powering up the hob displays input elements 20, 22, 24, and 26 that are assigned to the individual cooking zones of the hob, and a further input element 28 by which the upper left cooking zone and the lower left cooking zone can be operated as a combined cooking zone.

Figure 2:
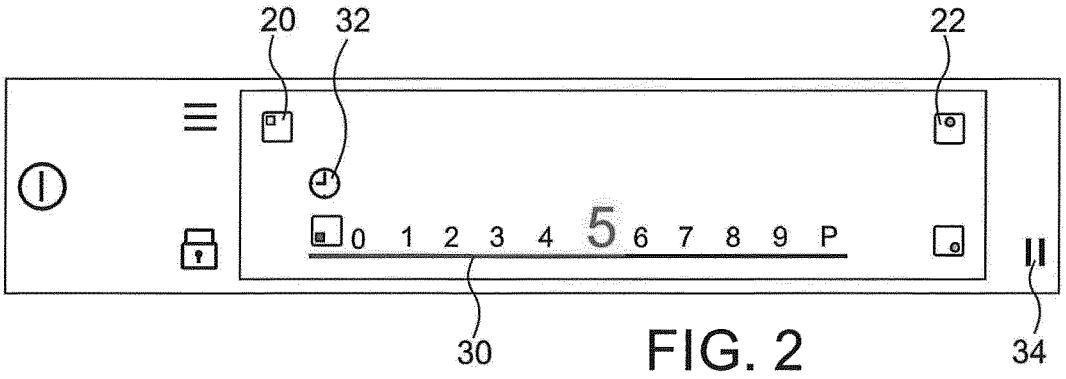
FIG. 2 shows the user interface of FIG. 1 in a second interface mode.

Whereas in the interface mode depicted in FIG. 1, referred to herein as the first interface mode, the input elements 20, 22, 44 and 26 for selection of the cooking zones all are represented in a normal display mode that is simultaneously applied to the input elements for all cooking zones, when selecting one of the cooking zones for use in a cooking process by touching the respective input element, such as input element 24 for the lower left cooking zone, the touchscreen interface is set into a second interface mode, as is shown in FIG. 2.

FIG. 2 shows an example of operating the touchscreen interface in a second interface mode which is entered by selecting the lower left cooking zone by touching the respective input element 24. In such second interface mode a power bar 30 indicating a choice of possible power levels and a further input element 32 depicted by a clock symbol for applying timer functions are displayed together with cooking zone input element 24 in a central region of the touchscreen interface. The user now can select a power level for the heating elements of the lower left cooking zone by touching the respective number in power bar 30, either by tapping directly on the respective number or by touching the power bar at zero and then dragging until the respective number has been reached. During touching power bar 30, the presently selected number is highlighted, such as in bold letters, in a different color, or is shown in a larger size. While input element 24 for selecting the lower left cooking zone as well as all further input elements for adjusting operating parameters for the lower left cooking zone thus are displayed in a highlighted fashion, the input elements 20, 22 and 26 for the other three cooking zones have been shifted into a peripheral region of the touchscreen interface, where they are displayed in a dimmed fashion. While in the second interface mode the focus thus is laid on the input elements that relate to a selected cooking zone or combined cooking zone, the user interface nevertheless always allows the user to switch to the inputs for another cooking zone simply by tapping on the respective cooking zone input element which although being displayed in dimmed fashion, still is visible.

As shown in FIG. 2, when in the second interface mode in which adjustments can be made in the operating parameters of the cooking zones, additional designated input elements can be activated, such as a "Pause" button 34 to the right of touchscreen interface 18.

Figure 3:
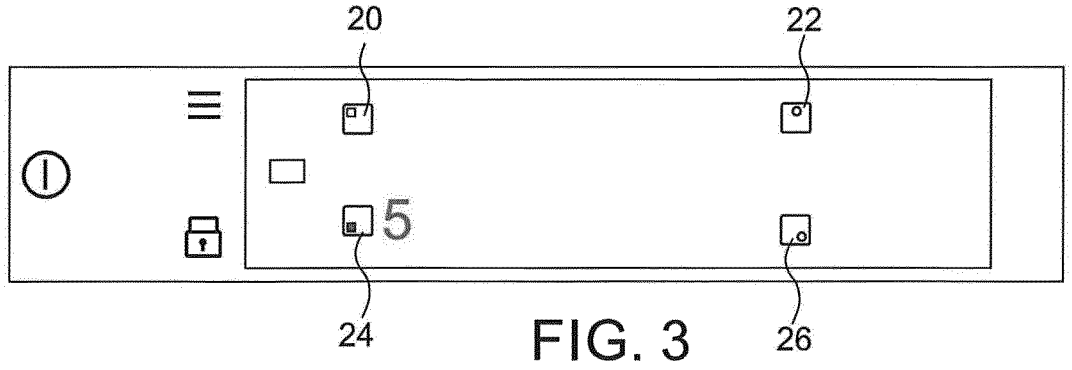
FIG. 3 shows the user interface of FIG. 1 in a first interface mode while one of the cooking zones operative.

Upon finishing the user input, the touchscreen interface again is set into the first interface mode, wherein as shown in FIG. 3 selected operating parameters are displayed aside the respective input element which designates the cooking zone. Thus, as shown in FIG. 3, the number "5" is displayed aside input element 24 for the lower left cooking zone, so as to indicate the power level that has been selected. Given that the other three cooking zones now as before are inactive, the spaces aside the respective cooking zone input elements 20, 22 and 26 remain blank.

Figure 4:
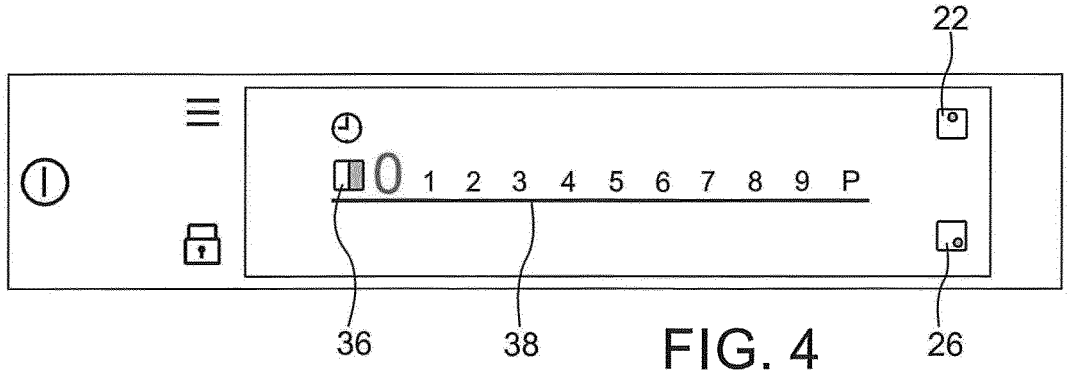
FIG. 4 shows the user interface of FIG. 1 in a second first interface mode pertaining to the operation of a combined cooking zone.

In FIG. 4 the user interface is illustrated in a state when the input element 28 for providing for a combined cooking zone has been activated. Rather than showing the input elements 20 and 24 for selecting the upper left and lower left cooking zones, there is displayed a combined element 36, wherein when the touchscreen interface is in the second interface mode a power bar 38 is shown aside the combined element 36. Similarly as was described above by reference to FIG. 2, the user can select a power level to be applied in the combined cooking zone by touching one of the number keys which range from 0 for power off to 9 for maximum power, or a key labeled "P" for power heating by which the cooking zone is operated for a limited duration at a steeper heating curve, i.e. is heated faster.

Figure 5:
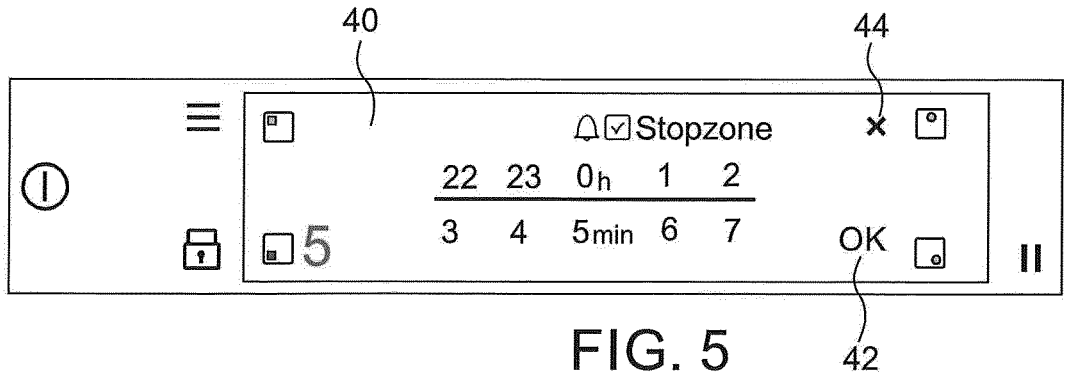
FIG. 5 shows the user interface of FIG. 1 in a second interface mode for setting timer functions.

FIG. 5 shows the user interface when starting from the situation shown in FIG. 2 the user activates the timer functions by touching input element 32. Then a timer setting window 40 is displayed, in which the user can select various timer functions, such as a timer which starts and/or stops the heating within the selected cooking zone cooking zone at a time or after a duration the user selects in be selected. Additionally or alternatively to setting such timer, an alarm can be set so as to notify the user at a time or after a duration to be selected. When the respective settings have been made, these settings are applied upon the user confirming the selection by tapping in the touchscreen interface at an "ok" field 42. In case the user wants to abort the setting of timer functions without saving any changes, this can be done by touching onto an escape field 44 which is marked by an "x".

Figure 6:
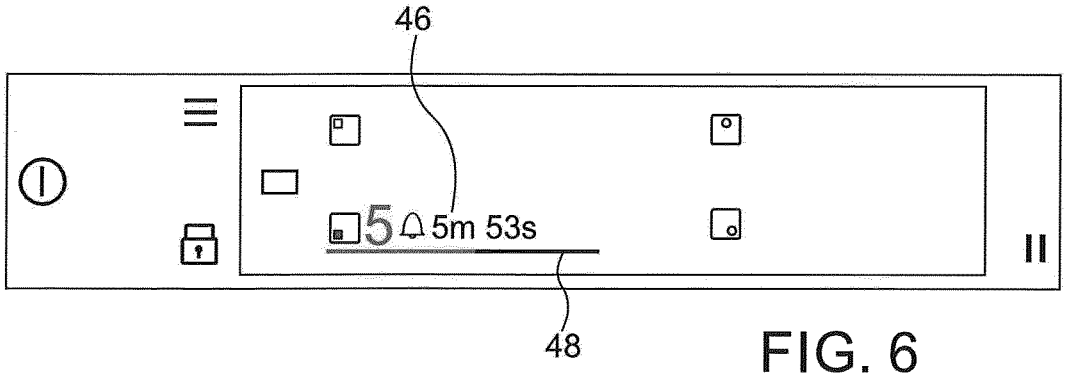
FIG. 6 shows the user interface of FIG. 1 in a first interface mode while one of the cooking zones is operated in a timer mode.

Upon having made selections in the timer section, these settings are displayed next to the input element 20, 22, 24 or 26 for the respective cooking zone, as it is shown in FIG. 6, where next to the power level there is provided for a numerical display 46 of the respective time. In FIG. 6 there further is shown a bar display 48, which either may be employed to indicate the selected power level, or which also can be used as a dynamic time bar display, the total length of which represents the total cooking time selected, and the colored length represents the elapsed cooking time.

Figure 7:
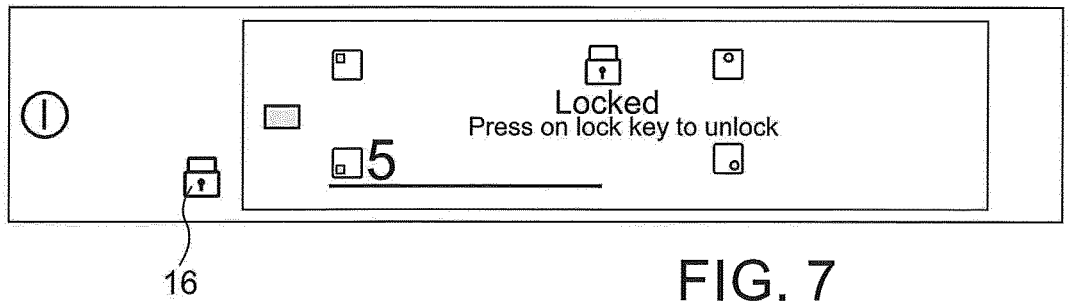
FIG. 7 shows the user interface of FIG. 1 when in a locked interface mode.

Note that FIGS. 5 to 7 further illustrate that the elements displayed in respect of a heated cooking zone can be displayed, fully or partially, in a different color, such as in red, so as to provide for an additional differentiation function and/or to provide for a warning that the respective cooking zone is hot. Similarly, also when the respective cooking zone has been switched off, but the cooking zone is still hot, the residual heat can be indicated to the user by displaying a certain warning sign, such as a symbol or text message, which may indicate the temperature level of the residual heat in several stages and which preferably also is displayed in color, so as to warn the user of the hot plate.

FIG. 7 shows the user interface, when the "lock" key 16 has been activated during a cooking process. While thus settings cannot be changed, a message is displayed in a central region of the touchscreen interface, and all symbols such as those of input elements 20, 22, 24, and 26 for selecting a cooking zones, and displays, such as the power indication for power level "5" for the activated lower left cooking zone, are displayed in a dimmed fashion and thus fade into the background of the displayed message.

Figure 8:
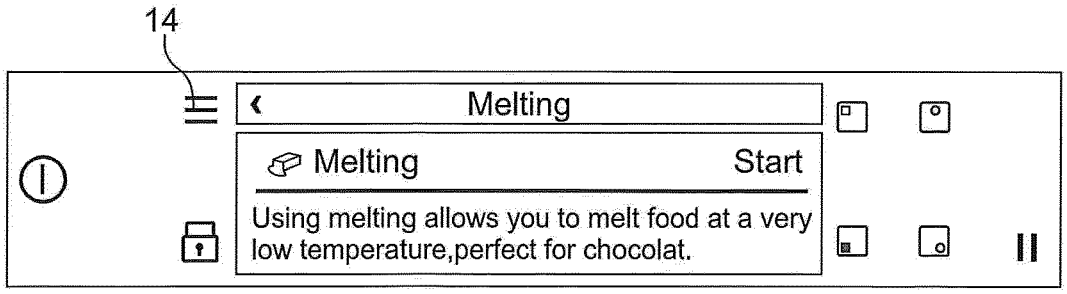
FIG. 8 shows the user interface of FIG. 1 when in a second interface mode for selected a cooking.

FIG. 8 shows the user interface in a state when the user has entered a choice of available cooking programs for the selected cooking zone by tapping on "Menu" button 14. In the state depicted in FIG. 8, a "melting" program can be selected by which the selected cooking zone is slowly heated to a low temperature as it is particularly advantageous for the melting of chocolate. Various further options can be accessed via "Menu" button 14, one example of which is the boiling mode referred to above wherein a selected cooking zone first is operated at a higher power level (such as to cause boiling of liquid), followed by a simmering stage during which the cooking zone is operated at a lower power level.

Note that FIG. 8 shows an embodiment of the user interface in which upon selection of a cooking zone all the input elements for selecting a cooking zone have been shifted to the right of a central region in which the actually set operations are displayed, wherein the input element of the cooking zone for which the parameters in question, here the melting operation, can be selected is highlighted by coloring the respective input element.

In preferred embodiments, the hob is provided with means for detecting the presence or absence of cooking ware in a cooking zone, wherein the user interface is configured to display input elements of the respective cooking zone when cooking ware is detected in such cooking zone. While thus the user interface can be configured to automatically switch on or display the respective input elements when a user places a pot within the cooking zone, in preferred embodiments such pot detection may be used to select a power level for heating a pot by shifting the pot to and from preselected cooking zones. In particular, the user interface may be configured to operate the hob in a "Power slide mode", in which the user assigns varying power levels to certain cooking zones, such as power level 2 for a first cooking zone, power level 5 for a second cooking zone, and power level 8 for a third cooking zone. When the pot is set for example on the second cooking zone and thus the pot is heated at power level 5, the user may select a different cooking temperature simply by shifting the pot to the first or third cooking zone. When it is detected that the pot has been shifted into another cooking zone, the initially used cooking zone is switched off, and the cooking zone to which the pot has been moved is switched on at the pre-selected power level. In this manner, the user can select different power levels for a cooking process in advance, wherein during the cooking process no adjustments have to be made at the user interface, but rather a power level can be selected simply by shifting the pot from one cooking zone to another.

REFERENCE SIGNS

10 panel
12 switch element "On/Off"
14 switch element "Menu"
16 switch elements "Lock"
18 touchscreen interface
20 input element "Upper left cooking zone"
22 input element "Upper right cooking zone"
24 input element "Lower left cooking zone"
26 input element "Lower right cooking zone"
28 input element "Combined cooking zone"
30 power bar
32 input element "timer functions"
34 input element "Pause"
36 combined element
38 power bar
40 timer setting window
42 "ok" field
44 escape field
46 numerical display
48 bar display

The invention claimed is:

1. A user interface for a hob that comprises at least two cooking zones, the user interface comprising:

a touchscreen interface for presenting operating parameters and input elements for adjusting said operating parameters, wherein the touchscreen interface is configured to display for each of the cooking zones a respective one of said input elements for selection of the respective cooking zone;

wherein in a first interface mode, the input elements for selection of the cooking zones are represented in a normal configuration that is the same for the input elements for all cooking zones;

wherein in a second interface mode the input element for a selected cooking zone is represented in a highlighted configuration different from the normal configuration applied to the input elements for the remaining cooking zones; and wherein in the second interface mode, the input element and at least one further input element for adjusting an operating parameter of the selected cooking zone are displayed in a central region of the touchscreen interface, and the input elements for the remaining cooking zones have been shifted to a peripheral region of the touchscreen interface, compared to the first interface mode.

2. The user interface of claim 1, wherein:

the cooking zones each have at least one heating element for heating the respective cooking zone, a controller is coupled to the user interface and the heating elements for controlling the heating elements based on inputs received at the user interface, and the user interface is configured to display the input elements of a respective one of said cooking zones when cooking ware is detected in the respective cooking zone and/or the controller is configured to deactivate the heating element of the respective cooking zone when an absence of cooking ware in such cooking zone is detected.

3. The user interface of claim 1, wherein in the second interface mode, the input element for the selected cooking zone is represented together with at least one further input element for adjusting an operating parameter of the selected cooking zone.

4. The user interface of claim 3, wherein the at least one further input element for adjusting an operating parameter of the selected cooking zone is formed by displaying a representation of possible values for the operating parameter.

5. The user interface of claim 1, further comprising at least one touch sensitive key element next to the touchscreen interface.

6. The user interface of claim 1, wherein the touchscreen interface comprises a polychromatic display.

7. The user interface of claim 1, wherein the touchscreen interface is configured for operation of at least two adjacent ones of said cooking zones as a single combined cooking zone by displaying the respective input elements and parameter indications as a single element that applies to all the cooking zones which constitute the combined cooking zone.

8. The user interface of claim 1, wherein the touchscreen interface is configured for operation in a child-safe mode in which all input elements are deactivated until input of a passkey at a single one of said input elements or activation of several of said input elements in a predetermined unlock sequence.

9. The user interface of claim 1, further comprising a sensor for detecting the temperature of a said cooking zone, of cooking ware present in said cooking zone and/or of a food item being processed in said cooking zone, wherein the controller further is configured to adapt the operation of the heating elements based on data received from said sensor.

10. The user interface of claim 1, wherein the touchscreen interface is configured for input and output of timer data for at least one of the cooking zones, wherein the controller further is configured to adapt the operation of the heating elements based on said timer data.

11. The user interface of claim 2, wherein the controller further is configured to generate audio signals in dependency of sensor data, user inputs and/or a selected operation function.

12. A user interface for a hob that comprises at least two cooking zones, the user interface comprising:

a touchscreen interface for presenting operating parameters and input elements for adjusting said operating parameters, wherein the touchscreen interface is configured to display for each of the cooking zones a respective one of said input elements for selection of the respective cooking zone;

wherein in a first interface mode, the input elements for selection of the cooking zones are represented in a normal configuration that is the same for the input elements for all cooking zones;

the cooking zones each having at least one heating element for heating the respective cooking zone; and a controller coupled to the user interface and the heating elements for controlling the heating elements based on inputs received at the user interface, wherein in a second interface mode the input element for a selected cooking zone is represented in a highlighted configuration different from the normal configuration applied to the input elements for the remaining cooking zones and wherein the user interface is configured to display the input elements of a respective one of said cooking zones when cooking ware is detected in the respective cooking zone and/or wherein the controller is configured to deactivate the heating element of the respective cooking zone when an absence of cooking ware in such cooking zone is wherein the touchscreen interface is configured to display said input elements and parameters that relate to temporarily disabled functions in a semitransparent or faded fashion.

13. A hob comprising:

a glass ceramic plate adapted to support cooking ware and having a first cooking zone, a second cooking zone, and a third cooking zone;

a first heating element, a second heating element, and a third heating element disposed beneath the glass ceramic plate and being respectively associated with the first cooking zone, the second cooking zone, and the third cooking zone; and a touchscreen interface operable via a glass panel forming an integral part of said glass ceramic plate, said touchscreen interface having a first interface mode and a second interface mode, wherein:

in the first interface mode: a first input element, a second input element and a third input element for the first cooking zone, the second cooking zone, and the third cooking zone, respectively, all are displayed in a common manner simultaneously applied to all said input elements, each said input element being displayed at a location on said touchscreen interface corresponding to a physical location of the respective cooking zone of the glass ceramic plate, and in the second interface mode: a selected one of said input elements, associated with a selected one of said cooking zones, together with a further input element therefor, are displayed in a middle region of said touchscreen interface in a manner different from the other input elements associated with the respective other cooking zones, which have been shifted to a peripheral region of the touchscreen interface compared to the first interface mode;

said touchscreen interface being adapted to transition from said first interface mode to said second interface mode upon user selection of said selected input element in said first interface mode;

said touchscreen interface being virtually invisible such that the touchscreen interface merges into an overall appearance of the glass ceramic plate when in a switched- off state, and being adapted to be switched on via a manual user activation and/or automatically in response to a cooking ware being placed on said glass ceramic plate within one of said cooking zones.

14. The hob of claim 13, said further input element displayed in the second interface mode being a power-level input comprising a plurality of available power levels, wherein a power level or temperature of the selected cooking zone can be adjusting by touching or dragging to one of the available power levels displayed in the touchscreen interface.

15. The hob of claim 14, wherein a still further input element for adjusting a still further operating parameter of the selected cooking zone is displayed in association with the selected input element therefor in said second interface mode.

16. The hob of claim 15, said still further input element comprising a timer input for inputting timer functions for the selected cooking zone.

17. The hob of claim 13, said touchscreen interface being further adapted to return to said first interface mode from said second interface mode after completion of user inputs for adjusting operating parameters of the selected cooking zone, wherein upon return to said first interface mode each of said input elements is displayed associated with operating parameters for the respective cooking zones that have been previously adjusted or selected.

18. The hob of claim 13, said touchscreen interface being adapted to further transition to displaying in said middle region thereof a subsequent selected input element and subsequent further input element for a subsequent selected cooking zone upon touching on of the other input elements, corresponding to the subsequent selected input element, displayed in the peripheral region of said second interface mode.

* * * * *